US006015097A

United States Patent [19]

VanPutten

[11] Patent Number: 6,015,097

[45] Date of Patent: Jan. 18, 2000

[54] FLOOR COATING MACHINE

[76] Inventor: Theron A. VanPutten, 7645 Timber Bluff, SE., Ada, Mich. 49301

[21] Appl. No.: 09/087,543

[22] Filed: May 29, 1998

Related U.S. Application Data

[63] Continuation-in-part of application No. 08/619,809, Mar. 15, 1996, abandoned.

[51] Int. Cl.[7] ..... B05B 1/16

[52] U.S. Cl. ..... 239/164; 239/170; 239/176; 239/562

[58] Field of Search ..... 239/146, 159, 239/164, 170, 176, 99, 373, 548, 562, 566, 550; 404/84.1, 93, 94, 101, 103; 118/323, 305; 401/48, 139, 137, 205; 15/98, 320, 322

[56] References Cited

U.S. PATENT DOCUMENTS

| | | | |
|---|---|---|---|
| 3,981,596 | 9/1976 | Melton | 401/48 |
| 4,087,048 | 5/1978 | Smrt | 239/146 |
| 4,124,315 | 11/1978 | Melton | 401/48 |
| 4,789,265 | 12/1988 | Wilson et al. | 404/75 |
| 5,302,207 | 4/1994 | Jurcisin | 118/713 |

*Primary Examiner*—Lesley D. Morris
*Attorney, Agent, or Firm*—Price, Heneveld, Cooper, DeWitt & Litton

[57] ABSTRACT

A machine for applying a liquid coating material such as floor wax, carpet protector or sealer, to a flat surface, such as a floor or the like, includes a first sealed vessel for containing compressed gas and a second sealed vessel for containing the liquid. A pressure regulator is provided for maintaining a predetermined positive pressure head within the liquid-containing vessel, and associated conduit is provided for conveying gas at the predetermined positive pressure to the second vessel. The machine includes at least one spray nozzle and a conduit for conveying liquid from the second vessel to the at least one spray nozzle. The spray nozzle is height adjustable to insure that the sprayed material is uniformly applied to the floor as a relatively light coat without having to spread the applied material. The vessels, conduit, pressure regulator and at least one nozzle are preferably supported on a wheeled cart to provide a machine which can apply a liquid coating uniformly to a large floor area in a very rapid manner without having to stop to refill the vessels, and without requiring any motors or other electrical equipment which need to be connected to an electrical outlet during operation of the apparatus. A method according to the invention includes the steps of supplying a compressed gas to a first sealed vessel, supplying a liquid to a second sealed vessel, withdrawing compressed air from the first vessel, and conveying the gas to the second vessel by use of a pressure regulator to maintain the second vessel at a predetermined positive pressure, and conveying liquid from the second vessel to at least one spray nozzle at the constant predetermined pressure, whereby liquid is discharged from the at least one spray nozzle at a substantially constant rate.

27 Claims, 3 Drawing Sheets

FLOOR COATING MACHINE

CROSS-REFERENCE TO RELATED APPLICATION

This application is a continuation-in-part of U.S. patent application Ser. No. 08/619,809, now abandoned entitled FLOOR COATING MACHINE, filed on Mar. 13, 1996, by Theron A. VanPutten, the entire disclosure of which is incorporated by reference herein.

BACKGROUND OF THE INVENTION

This invention relates to a machine and a method for applying a liquid coating to a surface, such as a floor, and more particularly to such a machine and method whereby liquid may be applied to a surface, such as a floor, in a generally continuous and progressive manner and at a substantially constant rate to form a generally uniform coating thereon.

Known methods for applying wax and other liquid coatings to hard floors, carpeting, or the like have generally involved applying the liquid, such as wax, sealer, fabric protection solution, etc., manually, such as with a mop or with a manually operated pump-type sprayer. Such manual methods have many disadvantages. Perhaps the biggest such disadvantage is that it is generally very difficult to apply a liquid coating uniformly to a floor surface using manual application techniques. For example, with a mop, the liquid is initially applied to the floor in the form of a thick layer or puddle, either by using the mop or by pouring the liquid directly onto the floor. The thick layer or puddle is then spread around using the mop. The thickness and uniformity of the resulting coating is very much dependent upon the skill, experience, and care of the particular worker.

It is also difficult to apply a uniform liquid coating to a floor using manual pump sprayers. Manual pump sprayers used for applying a liquid coating to a floor are generally comprised of a large canister-like container for the liquid and a manual pump mounted on the container which is used to deliver pressurized air to the space in the container above the liquid to cause the liquid to discharge through a nozzle under pressure when a manually operated valve is opened. One such device includes a pressure vessel which can be strapped to the back of a worker, and a hand-held spray wand with flexible tubing connecting the vessel with one end of the wand. The wand includes a nozzle at its free end, and a trigger-operated valve to allow pressurized liquid to flow through the nozzle. As with the mop application technique, the uniformity of the liquid coating so applied is very dependent upon the skill, experience, and care of the worker applying the coating.

A major problem that the worker has in applying a uniform coating with such a device is that the rate at which liquid is discharged from the nozzle constantly changes because the pressure in the space above the liquid constantly decreases as the liquid is discharged. In addition to the non-uniform rate at which the liquid is discharged from the nozzle, the uniformity of the spray pattern generally deteriorates as the pressure in the space above the liquid in the vessel decreases, i.e., the quantity of liquid applied to a surface generally becomes much greater near the center of the discharge pattern than near the periphery as the pressure forcing the liquid through the nozzle decreases. Another disadvantage with manual pump-type devices is that they have a relatively limited capacity and must be frequently refilled and repumped. Because of this, and because the devices are carried by the worker, such as on the back of the worker, the manual pump-type floor coating devices are extremely cumbersome and poorly suited for treating large surface areas, such as in office buildings, factories, airports, etc.

Another type of applicator which has been used for applying liquid coatings to floors includes an apparatus having a large liquid reservoir mounted on a wheeled cart above a lamb's—wool pad or a mop. The liquid is released by way of a valve which when opened allows the liquid to flow under the influence of gravity into a perforated manifold and through the perforations in the manifold to the floor below. Such a device supplies the liquid to the floor as a series of small streams and relies upon the pad or mop to spread the liquid over the floor. The result is a relatively non-uniform, streaky coating.

A still further type of applicator includes a frame, mounted on wheels, for supporting a liquid-storage tank that has a pressure feed mechanism for applying pressure to the liquid storage tank and delivering liquid to one or more selectively operable nozzles. Notably, the pressure feed mechanism of this known device dispense the liquid at a relatively low pressure, such that a stream, as opposed to a spray, of liquid is applied to the floor. The resulting rivulets of liquid must thereafter be spread by a mop-type finish spreader in order to cover the entire width of the machine being used. Similar to the other devices described above, the result is a heavy, non-uniform, streaky coating.

In addition, by dispensing the product as a low-pressure stream, the resulting relatively thick coating of material applied to the floor takes a significantly longer time to cure than a lighter coat, does not cure properly, and is usually cloudy and unattractive as well as remaining somewhat soft and non-durable. Furthermore, one coat is rarely sufficient to satisfactorily complete the job, and additional coats cannot be applied until the previously applied coat cures. As those skilled in applying floor coatings will appreciate, a series of well-cured light coats of finishing material is significantly more durable than applying one or more heavier coats. Therefore, the field of floor coating machines is in need of an apparatus that can efficiently spray finishing material as a continuous, generally uniform, thin coat such that streaking and pooling of the dispensed product, which typically results from applying thick coats of material, is avoided.

SUMMARY OF THE INVENTION

The present invention provides a convenient apparatus for quickly and easily applying a thin and essentially uniform liquid coating to a surface. The apparatus relies upon continuous precision spraying of the liquid onto the surface which is to be coated by conveying the liquid under uniform positive pressure to one or more spray nozzles. The invention takes advantage of the fact that a liquid can be discharged uniformly, and preferably in atomized form, from a spray nozzle at a constant rate, if the liquid is supplied to the nozzle at a constant positive pressure of sufficient magnitude, and provides a novel device for accomplishing this.

The objective of conveying liquid coating material to a spray nozzle at a constant pressure is achieved by an apparatus including a first sealed vessel for containing a compressed gas and a second sealed vessel for containing a desired liquid coating material. A pressure regulator and an associated conduit is provided for between the first and second vessel continuously conveying gas under positive pressure to the second vessel so as to maintain a predetermined pressure head in the second vessel. The apparatus also includes a conduit for conveying liquid from the second vessel to at least one spray nozzle. The spray nozzle is preferably connected to a manifold system that is adjustably attached to a bracket secured to the frame of the apparatus. By providing such an adjustment mechanism, the position of the manifold system, and therefore the nozzles connected thereto, the apparatus assures that the sprayed material is uniformly applied to the surface as a continuous coating extending across the width of the device, without gaps or overlaps, or related pooling or streaking of material and, therefore, without usually having to spread or level the material. The invention thus provides a relatively uncomplicated mechanical device for delivering a liquid at a constant, predetermined pressure to one or more adjustably positioned spray nozzles, and thereby provides a relatively inexpensive and efficient apparatus which will uniformly apply a liquid coating to a surface. In addition, a selectively actuable smoother/leveller member is provided to augment the uniformity of the coating so applied, where particular uneven surface conditions require extra measures to accomplish this. Nevertheless, the leveller member is typically not required.

The invention also provides an improved method for uniformly applying a liquid coating to a surface. The method involves supplying a compressed gas to a first sealed vessel and supplying a liquid to a second sealed vessel. The compressed gas in the first vessel is gradually withdrawn therefrom at a positive pressure greater than that present in the second vessel, to maintain a predetermined positive pressure in the second vessel. The liquid contained in the second vessel is thus subjected to the predetermined continuous positive pressure, and is conveyed at that pressure from the second vessel to at least one spray nozzle, from which the liquid is uniformly discharged at a substantially constant rate. Following this, but concurrently with the basic process, the applied liquid may optionally be additionally smoothed or levelled by use of a contact member moved with the spray nozzles over the surface.

DESCRIPTION OF THE PREFERRED EMBODIMENT

Figure 1:
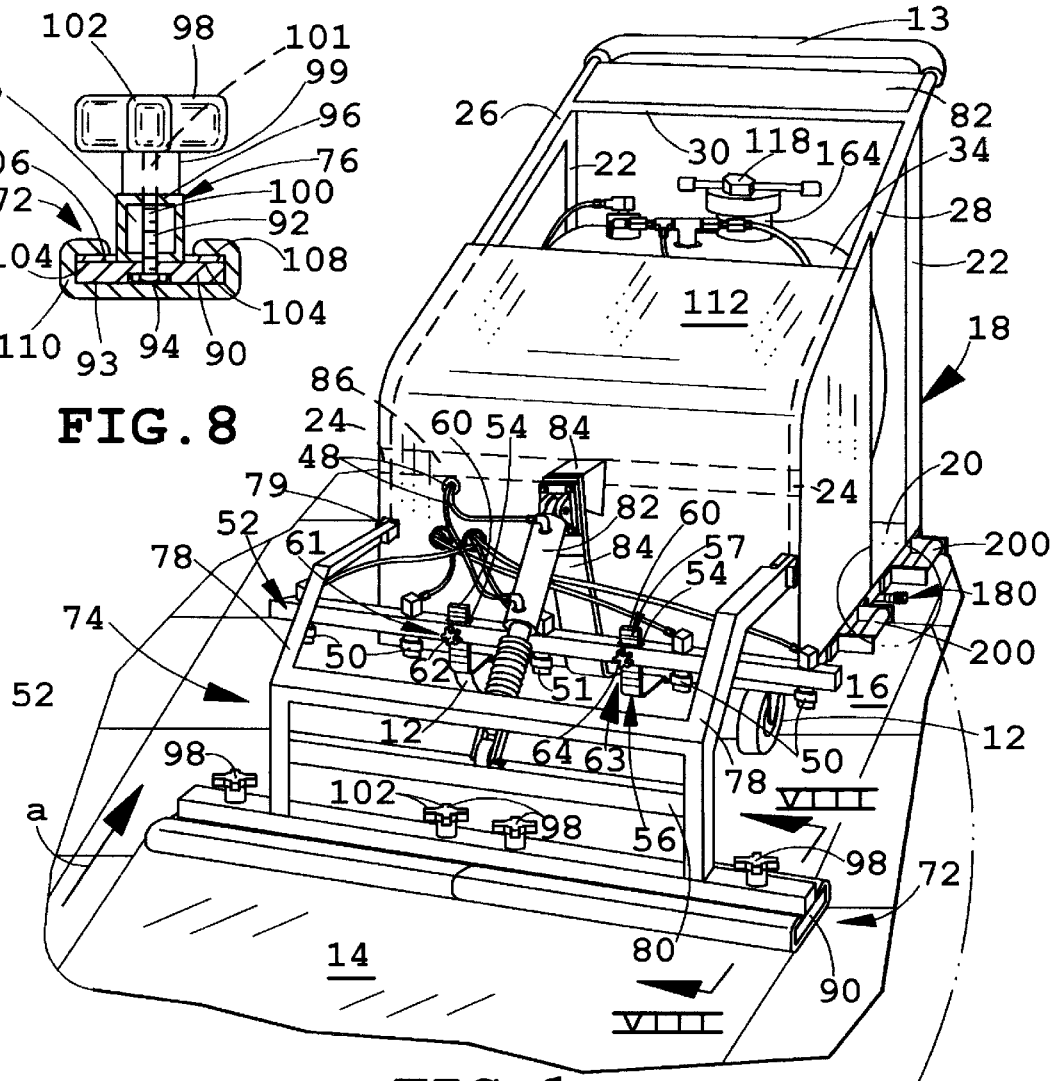
FIG. 1 is a perspective view of a preferred embodiment of a machine in accordance with the invention.

With reference to the drawings, and in particular to FIG. 1, there is shown an apparatus for applying a liquid coating material, such as wax, sealer, carpet protector, or the like, to a floor. The apparatus 10 preferably includes wheels 12 and a handle bar 13 which allows the apparatus to be pulled backwards, in a direction indicated by arrow "a," as a uniform swath of liquid coating material 14 (FIGS. 1 and 2) is sprayed onto the floor 16. Apparatus 10 includes a frame 18 including a base platform 20, upright vertical members 22 and 24, and generally horizontal longitudinal members or extensions 26 and 28, respectively. A support structure (not shown) is secured to the top side of base 20 to support a compartmentalized tank 34. Tank 34 is preferably a partitioned tank including two mutually isolated chambers, which will be described below in further detail with reference to FIG. 9. The two isolated chambers of tank 34 include a first chamber or vessel for containing compressed air or other gas, and a second chamber or vessel for containing a desired liquid coating material.

Figure 3:
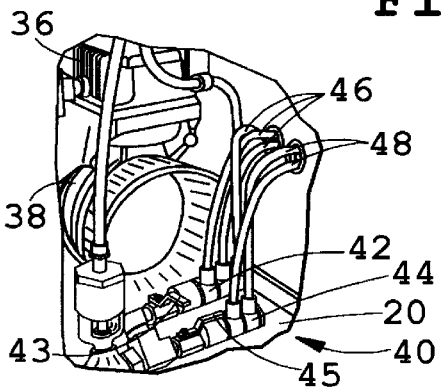
FIG. 3 is a fragmentary perspective view of a motor, a compressor and a valve structure for the machine shown in FIG. 1, illustrating the valves and supply lines for applying spray patterns of varying widths.
Figure 2:
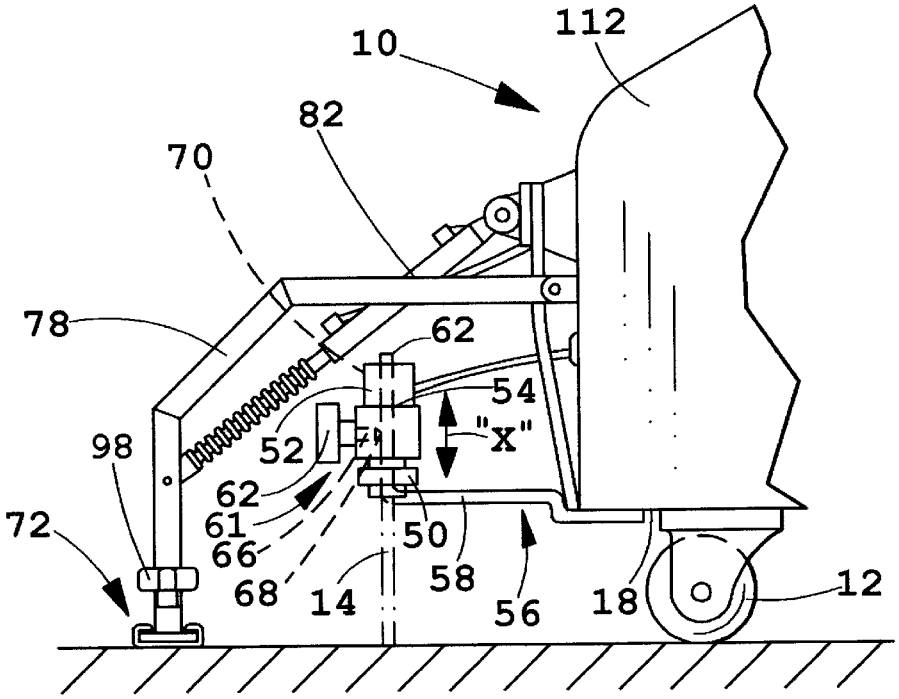
FIG. 2 is a fragmentary side elevational view of the machine shown in FIG. 1.

As shown in FIG. 3, also mounted upon base 20 is a compressor 36 driven by an electric motor 38, also mounted to base 20. Compressor 36 is operated to deliver compressed air to the compressed gas chamber or vessel of tank 34 to charge the compressed gas vessel to a pressure which is preferably well in excess of the desired or predetermined pressure at which the liquid coating material is to be conveyed to the spraying nozzles. Gas from the compressed gas vessel is conveyed through a conduit and a pressure regulator to the second vessel containing the liquid coating material, which is maintained at a predetermined positive pressure of a value less than that present in the first chamber. The liquid coating material is conveyed to a branched valve arrangement 40 including a valve 42 for selectively controlling the supply of fluid to apply a, e.g., four-foot wide swath of sprayed material to floor 16, and a valve 44 for selectively controlling the supply of fluid to apply a, e.g., three-foot wide swath of sprayed material 14 to floor 16. Valves 42, 44 include manually operated handles 43, 45, respectively, for opening/closing valves 42, 44. For example, for spraying a four-foot wide swath, the user manipulates handle 43 to open valve 42 and manipulates handle 45 to close valve 44, thus allowing fluid to pass through a set of conduits 46. Operating valves 42, 44 in the opposite manner causes fluid flow through a different set of conduits 48. After passing through conduits 46 or 48, the fluid is conveyed to a selected set of laterally disposed spray nozzles 50, and/or 51 mounted on a manifold member 52 (FIGS. 1 and 2). To illustrate the choices which can be made to produce particular spray swaths, nozzles 50, which in this embodiment are evenly spaced on opposite sides of central nozzle 51, dispense fluid in an atomized form having a wider spray pattern (e. g., eighteen inches) than central spray nozzle 51 (twelve inches) (see FIGS. 4–7), even though both spray at a constant rate when the liquid is supplied at a constant pressure. Both spray nozzles 50 and 51 are or may be of a known commercially available type, although the narrower-pattern central nozzle 51 is perhaps more frequently encountered. Both types preferably include a check valve (not shown) for minimizing dripping of fluid therefrom.

Preferably, as shown in FIGS. 1 and 2, manifold member 52 includes spaced vertical slots 54 for adjustably sliding member 52, in a direction "X" indicated in FIG. 2, on a pair of generally parallel brackets 56 attached to frame 18. Each bracket 56 has a horizontal leg 58, one end of which is attached to the underside of frame 18 in conventional fashion, and a vertical leg 60, preferably formed integrally with horizontal leg 58 and extending generally perpendicularly to leg 58 and floor 16 for adjusting the vertical position of manifold member 52. By adjusting the vertical position of manifold member 52, the user can select the height at which nozzles 50 and/or 51 spray material 14 onto floor 16. Note that nozzles 50 and 51 preferably spray fluid onto floor 16 in a relatively flat pattern extending along a path that is generally perpendicular to the direction of movement of apparatus 10, and in a fan-shaped pattern as viewed from the front of apparatus 10 (FIGS. 4–7). However, depending on the properties of the material being applied, e.g., viscosity, etc., the dimensions of the pattern will vary. For example, if the apparatus dispenses a light, low-viscosity wax, the width of material deposited on floor 16 by each nozzle (i.e., the bottom dimension of the fan-shaped pattern, see FIGS. 4–7) will be greater than when the material being dispensed is a heavier, high-viscosity material. As will be described in further detail below with respect to FIGS. 4–7, the change in spray pattern size from one material to the next can yield undesirable results (skipping or overlap). Therefore, to insure that the selected array of nozzles 50 and/or 51 provide the desired uniform coating swath for a particular material, manifold member 52 and its nozzle 50, 51 can be adjusted vertically.

To adjust the height at which nozzles 50, 51 dispense the desired material 14, manifold member 52 is lifted or lowered on vertical leg 60 of brackets 56, preferably, by use of a pair of adjusting blocks (not shown) positioned beneath member 52, on either side of brackets 56. (Note that the adjusting blocks in each such pair should have a height corresponding to that at which manifold member 52 must be placed for positioning the spray nozzles such that they will apply a uniform coating of material of a given viscosity to the floor.) After positioning member 52 such that its bottom surface abuts the top surface of the adjusting blocks, the user locks member 52 to brackets 56 by, preferably, tightening a pair of locking members 61, 63 attached to manifold 52. Each locking member 61, 63 includes a knob 62, 64 having a set screw 66 (FIG. 2) attached thereto, such that, when tightened, a free end 68 of screw 66 engages a flat surface 70 of brackets 56 to lock manifold member 52 to brackets 56. According to another method of adjusting the height of manifold 52, brackets 56 can include a series of horizontal score lines 57 or other such indicia that correspond to different types (e.g., different viscosities) of spraying materials. By aligning an edge of manifold 52 with a score line 57 corresponding to the desired material and locking manifold 52 to legs 60 with locking members 61, 63, nozzles 50, 51 can be positioned for optimum, uniform coating. In either case, by properly positioning and locking manifold 52, multiple thin coats can be applied to floor 16 in an efficient manner without having to make repeated runs over the coated area to cover gaps, and without having to "level" or spread a thick coating of the applied material. The application of liquid by apparatus 10 will be described in further detail with respect to FIGS. 4–7A.

Figure 4:
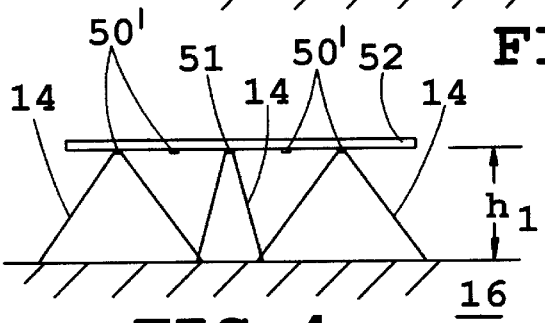
FIG. 4 is a simplified and reduced-scale front elevational view of a manifold system for the machine of FIG. 1, showing spray nozzles actuated for applying a four-foot swath of material to the surface and illustrating a spray pattern for a first position of the manifold system.
Figure 4A:
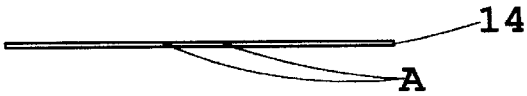
FIG. 4A is a top view of the spray pattern shown in FIG. 4.
Figure 5A:
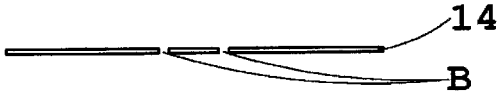
FIG. 5A is a top view of the spray pattern shown in FIG. 5.
Figure 6:
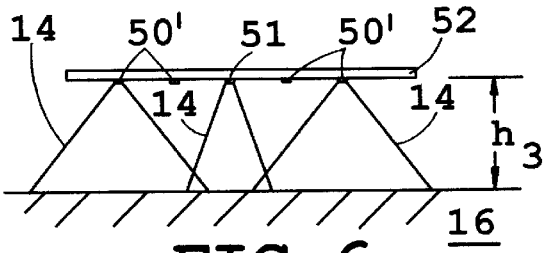
FIG. 6 is a front elevational view similar to FIGS. 4 and 5, illustrating a spray pattern for a third position of the manifold system.

Although the rate at which the user pulls apparatus 10 is a factor in determining the amount of material applied to floor 16, the height at which manifold 52 (and therefore spray nozzles 50, 51) is placed and the properties of the material being dispensed, will determine the effective width of the spray patterns. Therefore, manifold 52 must be properly positioned, otherwise an even coating of material cannot be applied without use of a smoother/leveller 72 (described below). As mentioned previously, nozzles 50, 51 are preferably designed to deliver a flat, fan-shaped pattern of mist or spray of liquid in a plane that is generally perpendicular to both floor 16 (FIG. 2) and to the direction of movement of apparatus 10. For example, FIG. 4 shows manifold 52 placed at a first height "h1" for applying a uniform coating of a particular material 14 onto floor 16 in a four-foot swath. In this arrangement, the two outboard spray nozzles 50' and the center spray nozzle 51 collectively spray material 14 over a uniform fourfoot swath. Notably, the spray patterns of nozzles 50' slightly overlap the spray pattern of center spray nozzle 51 at the point where the patterns contact floor 16, as shown by areas designated "A" in FIG. 4A. At height "h1," spray nozzles 50', 51 apply a generally uniform coat of material over the entire width of the related swath.

Figure 5:
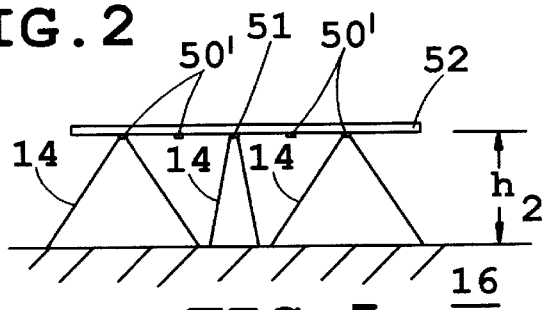
FIG. 5 is a front elevational view similar to FIG. 4, illustrating a spray pattern for a second position of the manifold system.

If manifold 52 is lowered to a height "h2" and the same material is sprayed, spray nozzles 50', 51 produce the spray pattern shown in FIG. 5. At height "h2," the spray patterns no longer intersect at the point where they contact floor 16; rather, the resulting four-foot swath includes gaps where no material 14 is applied to floor 16, as shown in FIG. 5 by areas designated "B." Clearly, this is an undesirable result because floor 16 will not be completely covered. To completely coat floor 16, further passes over the same general areas would be required, or heavier coats, that must be spread throughout the area, would have to be applied. This results in additional expense, wasted man-hours, and inefficiency, while yielding inferior results. In this case, manifold 52 would have to be repositioned (in accordance with the methods described previously) such that nozzles 50', 51 produce the spray patterns indicated in FIGS. 4 and 4A.

Figure 6A:
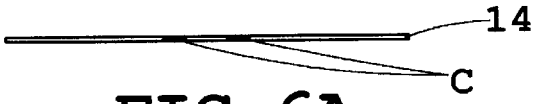
FIG. 6A is a top view of the spray pattern shown in FIG. 6.
Figure 7A:
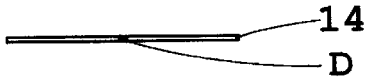
FIG. 7A is a top view of the spray pattern shown in FIG. 7.

On the other hand, if manifold 52 is adjusted to a height "h3," a height greater than both height "h1" in FIG. 4 and height "h2" in FIG. 5, a wider spray pattern of material 14 will contact the floor 16, thus resulting in significantly more overlap of sprayed material than that shown in FIG. 4, as indicated by areas "C" in FIG. 6A. This result is also undesirable due to the fact that the relatively large areas of overlap present excess areas of material 14. In such a case, smoother/leveller 72 would likely be required to smooth out the excess liquid to provide a uniform finish. More preferably, manifold 52 is repositioned for producing the closely coincident, contiguous spray patterns shown in FIGS. 4 and 4A, which may thus be thin, uniform, and fast-drying.

Figure 7:
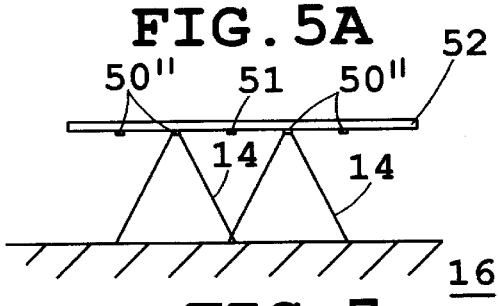
FIG. 7 is a front elevational view similar to those of FIGS. 4, 5, and 6 but showing spray nozzles actuated for applying a three-foot swath of material to the surface, illustrating a spray pattern for a first position of the manifold system.

Turning to FIG. 7, the nozzles and spray patterns used to apply a uniform coating of material 14 on floor 16 in an alternate width, e.g., a three-foot wide swath, are shown. Note that center nozzle 51 is now inactive and only those nozzles 50" disposed inboard on either side of spray nozzle 51 are used, and these are arranged to spray liquid material 14 in a pair of patterns that slightly overlap, as indicated by area "D" shown in FIG. 7A. Because pooling of material will not occur at area "D" if the user pulls apparatus 10 at a constant rate, a generally uniform three-foot path of finish can thus be applied without having to smooth or level the spray material.

A problem sometimes associated with spraying material from multiple nozzles is that spray droplets from the nozzles can impact each other and deflect prior to contacting floor 16, thus resulting in an uneven distribution of material. To remedy this problem, a second manifold system (not shown) can be provided that is displaced from and parallel to manifold member 52 for accommodating a selected number of the various nozzles, for example, the middle or regular spray nozzle 51, and/or every other nozzle in a given set or array, so that such nozzles are in their totality situated in a staggered arrangement with respect to the plane of floor 16. For example, the first and second such manifolds could be mounted on opposite sides of a center support member (not shown) or on manifold brackets (not shown) oriented in a plane generally parallel to floor 16, and along a line in the direction of movement of apparatus 10. Such center support or manifold brackets would include slots like those described above such that they, and hence the two sets of nozzles attached thereto, are slidably adjustable on brackets 56. By locking such manifold supports to brackets 56 at a predetermined position, the nozzles 50, 51 would spray, for example, a four-foot wide swath of material onto floor 16 from the same height, but in staggered arrangement, so that the chance of the spray droplets contacting each other is minimal or non-existent even though the spray patterns overlap slightly on the floor and the overall result shown in FIGS. 4–7 is maintained.

The apparatus 10 also preferably includes a smoother/leveller element 72 (FIGS. 1, 2, and 8) which is attached to a pivoting pad support assembly 74 comprised of a transverse positioning member 80, a pad mounting member 76, and spaced arms 78 fixed at one end to the mounting member 76 and pivotally connected at the other end to vertical frame members 24. The entire pad support assembly 74, and thus smoother/leveller element 72 is movably positioned by a linear actuator 82 which is pivotally mounted at one end to member 80 and pivotally connected at the other end to an actuator support bracket 84 secured to a transverse member 86 supported between vertical frame members 24.

Figure 9:
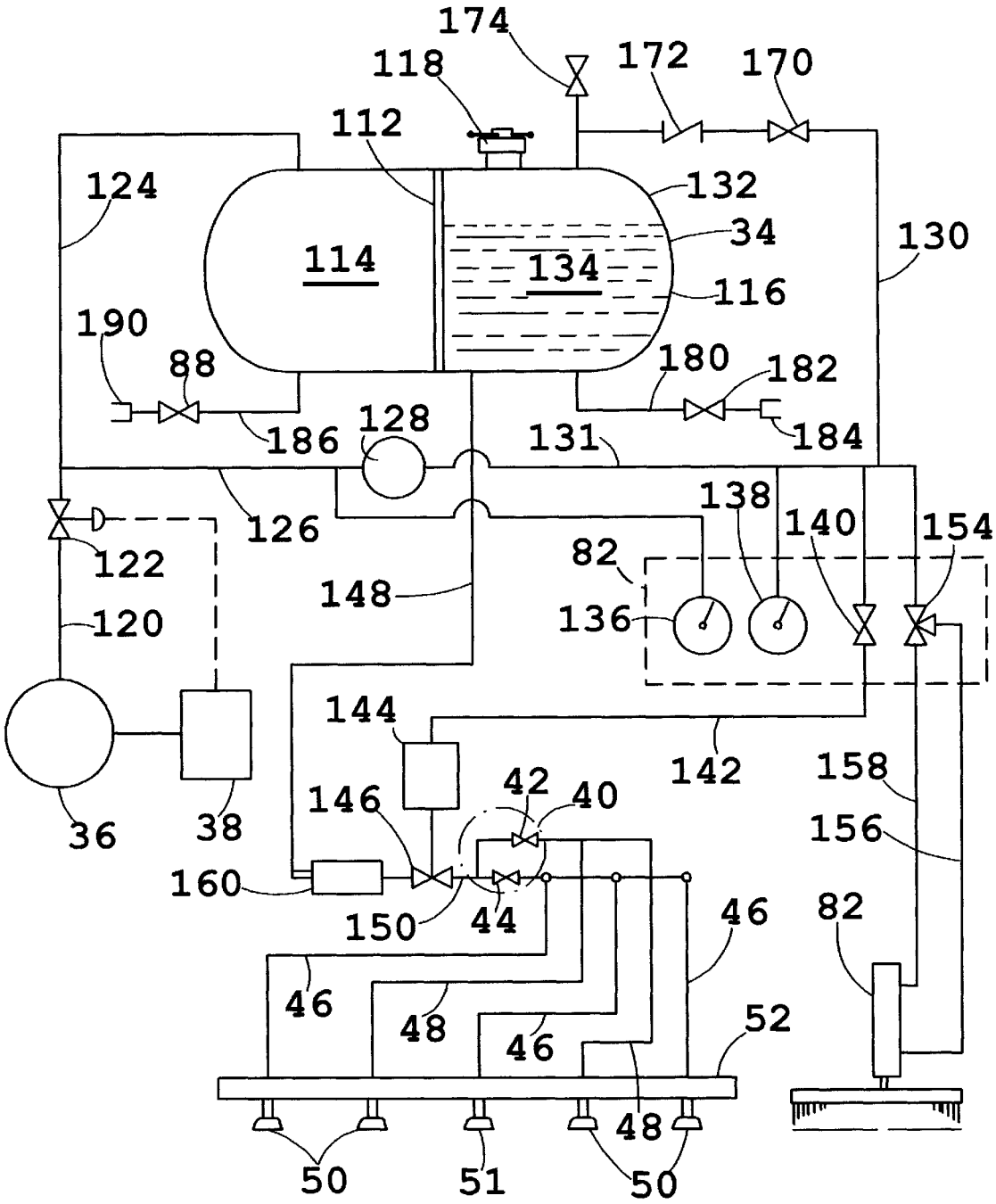
FIG. 9 is schematic diagram of the apparatus shown in FIG. 1.

A better understanding of the operation of apparatus 10, and of the methodology embodied therein, can be had by reference to FIG. 9, which schematically illustrates the process and apparatus of the invention. Tank 34 is divided by an internal partition 112 into two isolated vessels or compartments including a compressed gas compartment or vessel 114, and a liquid coating material compartment or vessel 116. Each of the vessels is substantially sealed to prevent loss of pressure therefrom. Vessel 116 includes a fill cap 118 which can be removed, such as by unscrewing, to allow vessel 116 to be filled with a desired liquid coating solution. Compressed air or other gas exiting compressor 36 passes through conduit 120 to a pressure switch valve 122 through conduit 124 and into vessel 114. Pressure switch valve 122 is designed to close at a predetermined relatively high pressure and to turn off electric motor 38 when the predetermined high pressure is reached. Compressed air from vessel 114 and conduit 124 is conveyed through conduit 126 to pressure regulator 128 and from the latter through conduit 130 to vessel 116. This compressed air fills the space 132 above liquid 134 and exerts a predetermined positive pressure on the liquid. As will be understood, this pressure is continuously maintained at a predetermined level by regulator 128, which continuously transfers higher pressure air from vessel 114 to the upper confines of vessel 116 as the liquid in the lower part of this vessel is sprayed out.

Adjacent to handle 13 is a control panel 82 having a first gauge 36 for indicating the pressure upstream of regulator 128 (i.e., the pressure in vessel 114), and a gauge 138 for indicating the pressure downstream of regulator 128 (i.e., the pressure inside vessel 116). Also located on control panel 82 is a switch or lever for a valve 140 which is preferably switchable between a fully opened and fully closed position. Opening valve 140 allows the compressed gas in conduit 131 to flow through valve 140 and through conduit 142 to pneumatic actuator 144, thereby opening valve 146 and allowing pressurized liquid to flow from vessel 116 through conduit 148 and 150 into valve structure 40 and its manually operated valves 42, 44, into conduit sets 46, 48 and to manifold 52, from which the pressurized liquid is conveyed to nozzles 50 and/or 51. Accordingly, in operation, the discharge of liquid coating material from nozzles 50 and/or 51 is initially and basically controlled by switching valve 140 between open and closed positions. As indicated above, the selection of a desired discharge path width is made by actuation of valves 42 and 44.

In accordance with a preferred aspect of the invention, linear actuator 82 is pneumatically operated and can be controlled by operating a switch or lever on the control panel which controls the flow of compressed air through a three-way valve 154. Preferably, the switch or handle can be easily moved from one of two positions which correspond to delivery of compressed air from line 131 through valve 154 to actuator 82 through conduit 156, or alternatively through conduit 158, the two possible flow paths corresponding to the raised and lowered positions of leveller member 72. For example, air passing through conduit 158 to actuator 82 would cause movement of an actuator piston downwardly or outwardly toward the member 72 to cause the latter to pivot downwardly into a floor-engaging position, whereas compressed air flow through conduit 156 would do the opposite, raising member 72 by pivoting the latter upwardly away from its floor-engaging position.

Conduit 148, which conveys liquid from vessel 116 to manifold supply conduit 150, preferably includes a strainer or screen 160 for removing particles or the like which may be present in the liquid coating, to prevent blockage of the orifice in spray nozzles 50, 51.

Isolation valve 170 isolates vessel 114 from vessel 116, whereby compressor 36 can be operated to pressurize vessel 114, while vessel 116 is open and unpressurized, as when it is being replenished with liquid coating solution. Conduit 130 is also preferably provided with a check valve 172 to prevent liquids or vapors from vessel 116 from entering pneumatic conduits 142, 156 and 158. A pressure relief valve 174 is also preferably provided off conduit 130 and the pressurized space at the top of vessel 116, to prevent over-pressurization of conduits 131, 130, 142, 46, 48, 156 and 158, which are preferably plastic tubing. Tank 34 is preferably a steel tank having a pressure rating which is well in excess of the maximum pressure which compressor 36 can deliver to tank 34. Again, the pressurization components and system maintain a constant pressure applied to the liquid in vessel 116, and thus to nozzles 50, 51, which will therefore deliver a uniform pattern of mist or spray of liquid which is directed generally perpendicular to floor 16, at a constant rate since the liquid is supplied to them at a constant pressure. A satisfactory result may be achieved when the nozzles are selected to deliver approximately 0.67 gallons per minute of liquid wax at a pressure of about 40 psig; however, higher pressures up to at least about 70–75 psig will generally provide even better results with optimal spray pattern uniformity and volumetric consistency. Of course, as mentioned previously, the particular nature of each medium to be dispensed (e.g., viscosity, cohesiveness, adhesiveness, etc.) will or may have an important effect in this regard. As mentioned previously, each nozzle preferably distributes liquid uniformly in a generally flat fan-shaped pattern aligned along a generally straight and narrow path (FIGS. 4A, 5A, 6A, and 7A) and each such spray pattern from each nozzle should be contiguous to the adjacent such spray pattern, with minimal overlap, so that their combined spray patterns form a continuous stripe-like swath.

Figure 1A:
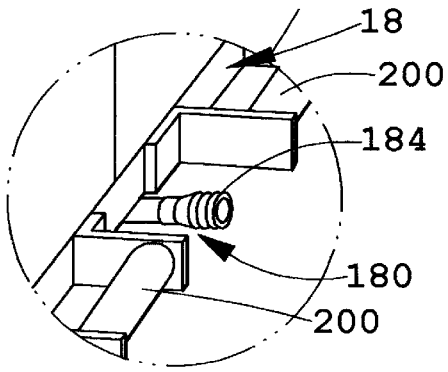
FIG. 1A is an enlarged fragmentary perspective view showing a portion of the apparatus of FIG. 1 which includes a coupling end of a drain conduit.

As shown in FIG. 1A, in order to facilitate draining and cleaning of the vessel 116, a drain conduit 180, with an associated valve 182 and coupling 184 (preferably a quick-disconnect coupling) are provided at the bottom of the vessel. Also shown in FIGS. 1 and 1A are handles 200 for aiding the transport of spray coating apparatus 10; for example, when loading apparatus 10 into a vehicle for transport to a job site.

For purposes of convenience, the compressed air vessel 114 can be provided with a utility outlet conduit 186 having an associated valve 188 and coupling 190 (preferably a quick-disconnect coupling) for connecting pneumatic tools if desired.

As mentioned previously, although nozzles 50, 51 spray liquid coating material very uniformly, there may at times tend to be a slight build-up of liquid in certain floor areas on account of localized depressions, etc., or a worker's inability to move the apparatus continuously or at a uniform rate. This is particularly true when the apparatus is first started, since it is difficult to begin spraying through nozzles 50, 51 and simultaneously begin moving backwardly at a uniform rate of speed. As previously mentioned, smoother/leveller member 72 (FIGS. 1, 2, and 8) is provided to level any unevenness in the thickness of the liquid coating material after it is sprayed from nozzles 50, 51, although this is usually or at least often unnecessary.

Figure 8:
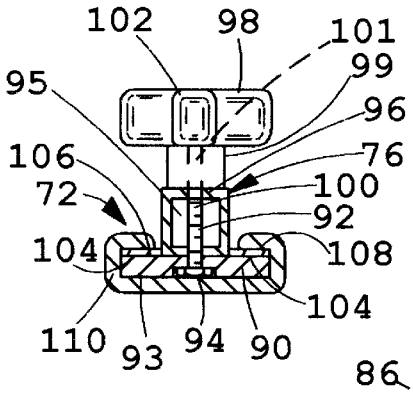
FIG. 8 is an enlarged cross-sectional end elevational view of a preferred leveller for the apparatus shown in FIG. 1.

With further reference to FIGS. 1 and 8, leveller 72 is comprised of at least one mounting plate 90 connected to cross member 76. Mounting plate 90 has at least one countersunk portion in its bottom surface 93 for accommodating a head 94 of a corresponding elongated securement member 92. To lock mounting plate 90 to cross member 76, securement member 92 is extended upwardly through the countersunk opening in member 90 and cross member 76 such that head 94 is seated in the countersunk portion. When assembled, member 92 extends through the central portion 95 and top 96 of cross member 76 (which is shown as being tubular in form), such that a plurality of knobs 98 each having a body 99 including a threaded female opening 101 can engage a threaded shank portion 100 of a corresponding plurality of securement members 92. When tightened, each knob 98 tends to pull each securement member 92, and thus mounting plate 90, upward toward cross member 76, to clamp member 76 between plate and knobs 98, and thereby secure mounting plate 90 to the pad support assembly 74.

When secured, a portion of top surface 104 of plate 90 is exposed on either side of the width of cross member 76 and includes a fastener, e.g., velcro strips 106, 108, for readily attaching a flexible pad 110 (e.g., having cooperating velcro portions) thereto. Pad 110 can be used to level the material applied to floor 16 without streaking. Preferably, a pair of mounting plates 90 are attached end-to-end to cross member 76, according to the method just described, and are readily changeable to accommodate pads 110 of varying length, e.g., pads for applying the above-described three or four foot wide spray patterns. Notably, knobs 98 have outwardly extending arms 102 to aid the user's grip for efficiently changing plate(s) 90. A preferred embodiment of smoother/leveller member 72 comprises a pad 110 made from a lamb's wool. Of course, the most optimum choice of material will be a function of the particular type of floor or the like to be coated, as well as the particular type of coating material, etc.

Smoother/leveller member 72 is preferably at least as wide as the strip of liquid which is sprayed from nozzles 50 and/or 51 and, as noted above, is preferably secured to mounting plate 90 by means of cooperating velcro strips 106, 108, which facilitate quick removal from the apparatus for cleaning or replacement. To note, although the apparatus has been shown and described with respect to applying either a three or four foot pattern to the floor, the apparatus can be designed to apply a strip of liquid coating of generally any width to a floor surface, including greater than 48 inches.

The pressure vessel 114 is preferably large enough to contain a sufficient quantity of air at a moderately high pressure (such as about 125 psig) to ensure discharge of a sufficient quantity of coating material from vessel 116 at a predetermined positive pressure (preferably within the range of about 35–75 psig) so that the liquid can be uniformly applied to at least several thousand square feet of floor. As an example, a liquid wax can be applied to approximately 24,000 square feet of floor, without having to repressurize vessel 114, when vessel 114 has a fluid capacity of 15 gallons, vessel 116 has a fluid capacity of 12 gallons, vessel 114 is pressurized to 150 psig, and a working pressure of 40 psig is maintained in vessel 116.

The apparatus can be used for applying generally any floor or surface treatment to floors or other surfaces, such as sidewalks or driveways. The apparatus, however, is not generally intended for use in applying liquids at elevated temperatures, nor is it generally intended for applying liquids or other materials having a relatively high viscosity. Examples of possible uses for the invention include the application of wax to various hard floors, the application of carpet protector to carpeting, and the application of sealers to various surfaces including rock and cement surfaces. In the case of liquid applications to carpets, as with most other applications, smoother/leveller 72 would typically be maintained in the elevated position (i.e., not in contact with the carpeting).

When vessels 114 and 116 are depressurized and empty, the apparatus is prepared for application of a liquid coating material to a surface by making sure that isolation valve 170 is closed. At this point, power can be applied to electric motor 38 to operate compressor 36 to begin pressurization of vessel 114. A 1.5 horse-power motor can be used to completely charge a 15 gallon vessel 114 to a pressure of 125 psig in approximately 5 minutes. While vessel 114 is being charged with compressed air, vessel 116 can be filled with a liquid coating material by removing fill cap 118 and pouring or pumping liquid into inlet 169 until vessel 116 nearly is full. When vessel 116 has been filled, fill cap 118 is replaced, and isolation valve 170 can be opened. Before filling vessel 116 with liquid, valve 140 should be set in the closed position. After vessel 114 is fully pressurized to the desired pressure, such as 125 psig, pressure switch valve 122 automatically closes and shuts off electric motor 38. Thereafter, the apparatus can be unplugged from an electrical outlet and the cord can be wound and stored on the apparatus. Thereafter, operation of the apparatus involves positioning the apparatus at a desired starting point on a floor or other surface. To begin application of the liquid to the floor, valve 140 is set to the open position causing pneumatic actuator 144 to open valve 146 allowing pressurized liquid to flow through valve structure 40 and nozzles 50 and/or 51. At the same time or shortly thereafter, the worker grasps handle 13 and moves backward at a relatively steady pace. When applying wax or other materials to floors, it will generally be desirable to place leveller member 72 in the raised non-floor contacting position because manifold 52 can be adjusted to a particular height for applying a uniform coating of material 14 to floor 16. Raising and lowering of leveller 72 is achieved by appropriate manipulation of valve 154.

A major advantage with the apparatus is that a large floor area can be treated very quickly with great uniformity, without having to stop to refill the vessels and without being connected to an electrical outlet. This is to say, after the tank 34 is fully pressurized, the apparatus operates for a substantial length of time entirely on the compressed air supply contained in vessel 114.

Various modifications to the preferred embodiment described above are possible without departing from the broader aspects and advantages of the invention. For example, compressor 36 and motor 38 can be eliminated in the event that compressed air is readily available, in which case vessel 114 can be filled using an external compressed air source. Additionally, smoother/leveller member 72, as suggested previously, can usually be left unused or even eliminated, or replaced by a squeegee or other desired type of member for spreading, smoothing, levelling, or otherwise acting on the surface of the applied liquid. Actuator 82 can be either eliminated and replaced with a non-expansible support member or with various alternative linear actuators which can be motor driven or manually operated. Compartmentalized tank 34 can be replaced with two separate vessels, or possibly comprise a single tank used with a powered onboard compressor or the like which is configured to maintain the desired consistent pressure head applied to the liquid at all times during use.

It is believed that the significant advantages provided by the present invention will be apparent to and appreciated by those skilled in the art upon consideration of the foregoing disclosure, and it is to be noted once again that an underlying concept is advanced which is specifically different from those addressed by the prior state of the art, notwithstanding the superficially similar attributes. It is to be understood that the foregoing detailed description is merely that of certain exemplary preferred embodiments of the invention, and that numerous changes, alterations and variations may be made without departing from the underlying concepts and broader aspects of the invention as set forth in the appended claims, which are to be interpreted in accordance with the established principles of patent law, including the Doctrine of Equivalents.

The invention claimed is:

1. A self-contained movable machine for applying a liquid coating to a floor, comprising:

a frame;

a vessel for holding a supply of the liquid;

at least one bracket having a first portion secured with respect to the frame and a second portion extending vertically from said first portion at a position displaced from the frame;

at least one spray nozzle disposed above and oriented generally orthogonal to said floor, said nozzle arranged to spray a dispersion of the liquid in a spray pattern disposed in a plane oriented generally perpendicular to the floor and to the direction of movement of the machine, and a manifold system extending between said vessel and said at least one spray nozzle to convey the liquid to said spray nozzle; and a nozzle support member carrying said at least one nozzle and positioning it in said generally orthogonal orientation, said support member being adjustably attached to said bracket for selectively positioning said at least one nozzle at selected different heights while maintaining substantially the same said orientation of said nozzle, including a predetermined height at which said at least one spray nozzle sprays the liquid onto the floor in a pattern of selected size.

2. The machine of claim 1, wherein said nozzle support member has at least one slot for receiving a free end of said second bracket portion, such that said support member is slidably disposed on said second portion.

3. The machine of claim 2, wherein said nozzle support member includes at least one locking member for locking said nozzle support member to said bracket, said locking member positioned adjacent said slot and perpendicular to a plane defined by said slot.

4. The machine of claim 3, wherein said second bracket portion includes a plurality of positioning indicia for disposing said nozzle support member at different ones of said selected heights.

5. The machine of claim 1, wherein the frame is supported by a plurality of wheels for traversing the floor.

6. The machine of claim 1, wherein said at least one spray nozzle dispenses liquid onto the floor in a fan-shaped spray pattern.

7. The machine of claim 1, wherein said at least one spray nozzle includes a plurality of mutually spaced individual nozzles and each of said nozzles is mounted to have its spray axis oriented generally parallel to the axes of the other nozzles in said plurality and in said plane, said nozzles being arranged to produce spray patterns which are generally contiguous to one another to form a continuous spray path.

8. The machine of claim 1, wherein said nozzle support member carries at least a portion of said manifold system.

9. The machine of claim 7, further comprising first and second sets of said nozzles, each such set arranged to produce a combined spray pattern of a width different from that of the other such set, and manually actuateable controls for selecting one or the other such set of nozzles to obtain one or the other of said spray patterns.

10. The machine of claim 1, wherein at least one of said spray nozzles produce a fan-shaped spray pattern.

11. A self-contained movable machine for applying a wide and generally uniform thin coating of liquid to a floor, comprising:

a first vessel for containing a supply of compressed gas at a predetermined initial pressure;

a second vessel for containing the liquid to be applied;

a pressure regulator and associated conduit for conveying a continuing supply of said compressed gas from said first vessel to said second vessel in a manner maintaining a generally uniform predetermined positive operating pressure within said second vessel and applied to said liquid, said predetermined positive operating pressure being lower than said initial pressure;

a plurality of spray nozzles, each oriented above and generally orthogonal with respect to said floor and arranged to spray said liquid onto said floor as a dispersion having a predetermined spray pattern when receiving liquid at said predetermined positive operating pressure, such that said plurality of nozzles together spray a continuous dispersion of said liquid over a preselected target area larger than the spray pattern of any single nozzle;

a manifold for conveying liquid from said second vessel to said spray nozzles under said predetermined positive operating pressure; and a mounting platform to support and carry said first and second vessels, said pressure regulator, said spray nozzles and said manifold together as a unit.

12. The machine of claim 11, wherein said plurality of spray nozzles are mutually spaced from one another and arranged so that their respective spray patterns are generally contiguous one another at the point where said spray patterns contact the floor, to thereby provide a generally uniform spray of swath of predetermined width.

13. The machine of claim 12, wherein at least one of said spray nozzles dispenses liquid onto the floor in a fan-shaped spray pattern.

14. The machine of claim 11, wherein said plurality of spray nozzles are carried on an adjustably movable member for conjoint repositioning by movement of said member.

15. The machine of claim 14, including a support for said adjustably movable member and manually actuable securement means for releasably securing said movable member to said support.

16. The machine of claim 11, wherein said vessels, conduit, pressure regulator, and nozzles are supported on a wheeled cart, for traversing the floor.

17. The machine of claim 16, further comprising an air compressor and conduit supported on said cart for portably pressurizing said first vessel.

18. The machine of claim 11, wherein said liquid comprises a floor wax and said pressure regulator maintains said predetermined positive pressure at a level of at least about 35 psig, to spray said wax as a dispersion.

19. The machine of claim 11, wherein said first and second vessels constitute mutually separate compartments of a single tank.

20. A method of applying a floor treatment liquid to a floor, the method comprising the steps of:

providing a movable platform;

supplying a compressed gas to a first sealed vessel carried on said platform and retaining said gas within said vessel so that it is pressurized;

supplying a floor treatment liquid to a second sealed vessel carried on said platform;

gradually withdrawing compressed gas from said first vessel and applying it to said second vessel as pressure is released from said second vessel so as to maintain a positive pressure within said second vessel which is less than the pressure in said first vessel;

applying said positive pressure within said second vessel to the floor treatment liquid therewithin;

conveying liquid under said supplied positive pressure from said second vessel to at least one spray nozzle carried on said platform; and adjustably positioning said at least one spray nozzle with respect to said platform such that it sprays the liquid downwardly onto the floor along a plane generally perpendicular to the floor in a spray pattern of selected size.

21. The method of claim 20, further including the step of regulating said positive pressure within said second vessel to maintain a generally uniform pressure head therewithin whereby said liquid may be sprayed from said nozzle at a substantially constant rate.

22. The method of claim 21, wherein said positive pressure within said second vessel is maintained at a level within the range of about 35 to 75 psig.

23. The method of claim 22, further including the step of passing a smoother/leveller over the liquid immediately after it has been sprayed upon said floor.

24. The method of claim 23, further including the step of using a softly compliant elongated member as said smoother/leveller.

25. The method of claim 21, further comprising the steps of:

adjustably mounting said at least one nozzle on a vertically-extending member attached to said platform;

providing at least one indexing member for positioning of said nozzle at a predetermined position along said vertically extending member;

adjusting the vertical position of said nozzle by moving it into alignment with a portion of said indexing member;

and releasably securing said nozzle in place at said position of alignment;

whereby said nozzle has an operating position at a height corresponding to that height at which said nozzle sprays a particular liquid material having a particular viscosity onto the floor in a pattern of desired size.

26. A machine for applying a coating of liquid to a floor, comprising:

a vessel for holding a supply of said liquid;

a plurality of mutually spaced spray nozzles arranged to spray a dispersion of said liquid onto said floor in a series of adjacent spray patterns which are mutually contiguous at the point where they intersect said floor and which together extend continuously across a swath of predetermined width;

a manifold system extending between said vessel and each of said spray nozzles to convey said liquid to each;

a valve system operatively disposed between said vessel and said manifold system for selectively controlling the supply of liquid through said manifold to said spray nozzles;

a manually controllable movable operating platform for supporting and carrying said vessel and said plurality of nozzles and moving them over a floor to apply said liquid thereto in said swath of predetermined width, said platform including manually actuable controls for operating said spray nozzles; and said valve system including a plurality of valves and related conduits for selectively conveying the liquid to different sets of said spray nozzles corresponding to different widths of said swath.

27. The machine of claim 26, wherein said valves are manually operable.

* * * * *